US008887922B2

(12) United States Patent
Lilly et al.

(10) Patent No.: US 8,887,922 B2
(45) Date of Patent: Nov. 18, 2014

(54) SCREEN DECK ASSEMBLY

(75) Inventors: Timothy A. Lilly, Princeton, WV (US); Gregory L. Rayburn, Chapmanville, WV (US); Todd Boyter, Gastonia, NC (US); Curtis Boyter, Gastonia, NC (US)

(73) Assignee: Norris Screen and Manufacturing, LLC, Tazewell, VA (US)

( * ) Notice: Subject to any disclaimer, the term of this patent is extended or adjusted under 35 U.S.C. 154(b) by 714 days.

(21) Appl. No.: 12/984,339

(22) Filed: Jan. 4, 2011

(65) Prior Publication Data

US 2013/0140219 A1 Jun. 6, 2013

Related U.S. Application Data

(60) Provisional application No. 61/323,089, filed on Apr. 12, 2010.

(51) Int. Cl.
*B07B 1/49* (2006.01)

(52) U.S. Cl.
USPC ..... 209/405; 209/399

(58) Field of Classification Search
USPC ..... 209/392, 395, 397, 399, 403, 405
See application file for complete search history.

(56) References Cited

U.S. PATENT DOCUMENTS

| | | | | |
|---|---|---|---|---|
| 4,909,929 | A | 3/1990 | Tabor | |
| 5,377,846 | A * | 1/1995 | Askew | 209/405 |
| 5,791,495 | A * | 8/1998 | Gero et al. | 209/395 |
| 7,413,087 | B2 | 8/2008 | Kriel | |
| 2004/0074821 | A1 | 4/2004 | Russell et al. | |
| 2005/0189265 | A1 | 9/2005 | Malmberg | |
| 2006/0196813 | A1 * | 9/2006 | Kadel | 209/405 |
| 2009/0294335 | A1 | 12/2009 | Roppo et al. | |

OTHER PUBLICATIONS

International Search Report dated Feb. 8, 2012 for PCT/US2011/032005.

* cited by examiner

*Primary Examiner* — Stefanos Karmis
*Assistant Examiner* — Kalyanavenkateshware Kumar
(74) *Attorney, Agent, or Firm* — Birch, Stewart, Kolasch & Birch, LLP

(57) ABSTRACT

A screen deck assembly has an elongated connecting member for securing screen panels to a vibratory machine. The connecting member has a first end and a second end, a body, a transverse arm contiguous with and generally perpendicular to the body, and a radial dome top extending above the transverse arm such that a locking channel is formed between the transverse arm and the radial dome top. A screen, which has a locking profile that corresponds to the locking channel in the connecting member, is detachably secured to the connecting member by sliding or pressing the locking profile into the locking channel.

13 Claims, 9 Drawing Sheets

100

660

SCREEN DECK ASSEMBLY

CROSS REFERENCE TO RELATED APPLICATIONS

This application claims the benefit of U.S. Application Ser. No. 61/323,089, which was filed Apr. 12, 2010.

FIELD OF INVENTION

The invention relates to machinery for classifying, separating, and sorting solids, and more specifically to a system for securing a screen deck assembly to a vibratory machine used for sorting solid materials.

BACKGROUND

Vibratory screening machines are used in the bulk materials handling industry to classify by size bulk particulate materials such as mineral bearing ore. Vibratory screening machines usually include screen decks supported on a vibratory frame structure that is operatively linked to a motorized vibratory mechanism.

The modular-type screen decks typically have a matrix of screen panels mounted on a number of steel runners. The steel runners are mounted on a steel grid or lattice-type structure, the grid forming part of the vibratory frame structure. The vibratory frame structure, together with the motorized vibratory mechanism, is normally supplied by a first equipment manufacturer, and the runners and screen panels are produced by a second manufacturer.

The screen panels wear as the particulate materials flow across and through the screen panel apertures, which creates an occasional need to replace the screen panels and/or the runners. The screen panels are secured to the runners by a series of inserts, pins, and collars. The replacement of screen panels usually requires the removal of all the collars, inserts, and pins from the runners and the subsequent replacement of the screen panels, followed by the re-attachment of the collars, inserts, and pins. This procedure is time consuming and labor-intensive and causes substantial equipment downtime. Thus, there is a need for an improved screen panel and runner system that reduces wear, and provides for more rapid replacement of worn items when it is necessary to do so.

SUMMARY

The present invention solves these problems by providing a pinless screen system with an elongated connecting member attached directly to a vibratory machine and adapted for securing a screen panel to the vibratory machine. The elongated connecting member has a self-contained locking channel for slidably receiving a corresponding locking profile in the screen panel.

A first aspect of the invention is a screen deck assembly including an elongated connecting member having a first end and a second end and comprising a body, a transverse arm contiguous with and generally perpendicular to the body, and a radial dome top extending above the transverse arm such that a locking channel is formed between the transverse arm and the radial done top; a screen having a locking profile adapted for corresponding to the locking channel formed between the radial dome top and the transverse arm; the screen further comprising an internal support bar molded in the screen for adding latitudinal stiffness to the screen, an alignment tab on a side of the screen for aligning a screen to an adjacent screen, a raised side strip along a side of the screen for keeping product to be screened from falling off the side of the screen, and a dam post along the side of the screen adapted for securing a dam to a screen; a dam detachably positioned on top of and extending across the screen; a dam locking cap having a recessed opening for receiving one or more dam posts and a dovetail adapted for receiving a dam; and a locking key pressably secured within the dam locking cap for securing the dam to the top surface of the screen.

A second aspect of the invention is a screen deck assembly, including a screen having a locking profile adapted for corresponding to a locking channel between a transverse arm and a cap; an elongated connecting member for connecting the screen to a vibratory machine, the elongated connecting member having a body, a transverse arm contiguous with and generally perpendicular to the body, and a cap extending above the transverse arm such that a locking channel is formed between the transverse aim and the cap.

A third aspect of the invention is an apparatus including an elongated body having a length extending from a first end to a second end; a transverse arm contiguous with and generally perpendicular to the elongated body, wherein the transverse arm extends the length of the elongated body; and a cap extending above the transverse arm such that a locking channel is formed between the transverse arm and the cap along the length of the elongated body.

A fourth aspect of the invention is a vibratory screen, including a molded side locking profile adapted for corresponding to a locking channel in an elongated connecting member; an internal support bar molded in the vibratory screen for adding latitudinal stiffness to the screen; an alignment tab on a side of the vibratory screen for assuring proper alignment to an adjacent screen; and a raised side strip around a side of the vibratory screen for helping to maintain a product to be screened on the vibratory screen.

The screen panel sections or screens can be attached to a vibratory machine for sorting solid materials, e.g., coal, aggregate, etc., based on particle size. The screens can have any shape or size, but usually the screens come in sizes proportional to the vibratory machine and the area over which the screen deck assembly is positioned. The screens typically are square or rectangular and are positioned adjacent one another over a large screening surface area. The screens can include a molded side locking profile adapted for corresponding to a locking channel formed between a radial dome top and a transverse arm on the elongated connecting member, and which provides superior screen locking power. The screen can be secured to the elongated connecting member by positioning the locking profile on the screen in the locking channel on the elongated connecting member. An internal support bar can be molded into the screens to add latitudinal stiffness to the screen. The screens can include one or more alignment tabs on the sides for assuring proper alignment of each screen with an adjacent screen. A raised side strip can be included for added wear protection and to help keep material being screened, e.g., coal, aggregate, etc., in the screening area of the screen.

The screen can include one or more dam posts adapted for receiving a dam which is used to divert material being screened. The dam posts can be used to secure a dam to one or more sections of screen. hen assembled, dam posts from adjacent screens form a-walled protrusion, preferably a rhomboid shape with an aperture in the middle, at each 12 intersection, thereby allowing the dam, dam locking cap, and locking key to be installed easily onto a screen panel section. The dam locking cap can have a recessed shape for connecting a locking cap to the dam post. The dam locking cap also can have a dove-tail section on each side for connecting the dam locking cap to the dams. The dam locking cap can be held in place on one or more dams positioned on a screen by pressing a locking key downward into a locked position through the dam locking cap and into the aperture formed by the dam posts. The locking key can be pressed down until the top of the locking key head is level with the dam locking cap. The dam locking cap can be held down by the head of the locking key, and in turn the locking cap holds the dams in place on the screen. To remove the dam assembly, a lever, such as a screwdriver, flat bar, etc, can be used to raise the locking key into an unlocked position thereby allowing the dam locking cap and dam to be removed.

Alternatively, the dam posts can be positioned on the side of the screen approximately 1 to 2 inches inward from the corner of the screen. hen adjacent screen panels are placed together, the conjoined dam posts form a rhombus or other shape corresponding to a recessed section in the dam cap. The conjoined dam posts have an aperture for receiving a corresponding locking key. A double dam cap can be used to secure the dam onto the top surface of a screen. The double dam cap has an aperture at each end which corresponds to the aperture formed in the conjoined dam posts. A recessed portion in the double dam cap corresponds to the shape of, and fits over the top of, the dam. hen placed over a dam, the double dam cap encompasses two conjoined dam posts which preferably are on adjacent screens. The double dam cap can have an indentation along its top surface for receiving a locking key which also is known as a dam wedge or, alternatively, a wedge.

A dam wedge can have two posts corresponding in shape and length to the aperture which runs through the double dam cap and the conjoined damp posts. The dam wedge is shaped to correspond to an indentation along the top surface of the double dam cap. The dam wedge can have a tab on each end that extends beyond the posts. The tabs provide a means for removing the double dam wedge from the double dam cap simply by pulling up on one of the tabs.

An elongated connecting member for securing one or more screens to a vibratory machine can be included. The elongated connecting member includes a body, a transverse arm contiguous with and generally perpendicular to the body, and a radial dome top extending above the transverse arm such that a locking channel is formed between the transverse arm and the radial dome top.

The radial dome top is positioned above the transverse arm such that a locking channel for receiving a screen is formed between the transverse arm and the radial dome top. The radial dome top preferably has about a ½" radius and a smooth surface, which makes up part of the locking channel that accepts and locks into place the screen panels. The locking channel preferably extends the entire length of the elongated connecting member. The locking channel can allow a vibratory screen to be pressed down or slid into a locked position above a vibratory machine. The locking channel can be a locking receiving groove that extends the entire length of the elongated member and which holds the screen panels in place.

The transverse arm on the elongated connecting member can support screen panels of all sizes. The transverse arm also can have large radius gussets to add strength to the transverse arm. The size and shape of the gussets are calculated to provide maximum strength to the transverse arm without adding weight to the vibratory machine.

The radial dome top, transverse arm, and gussets can be joined with a body having a first end and a second end and being extendable between one or more supports on a vibratory machine. The elongated connecting member can be a single steel bar that is the supporting member for the screen deck assembly and which secures the screen panels onto a vibratory machine. The elongated connecting member can be connected to a vibratory machine by any mechanical means known to those skilled in the art, such as by welding, mechanical brackets or braces, screws, bolts, etc. The most preferred means for connecting the elongated connecting member to an existing vibratory machine support is by welding. The elongated connecting member provides the strength and the locking mechanism for quickly installing and changing screen panels on a vibratory machine.

BRIEF DESCRIPTION OF THE DRAWINGS

The present invention is described with reference to the accompanying drawings. In the drawings, like reference numbers indicate identical or functionally similar elements.

DETAILED DESCRIPTION

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
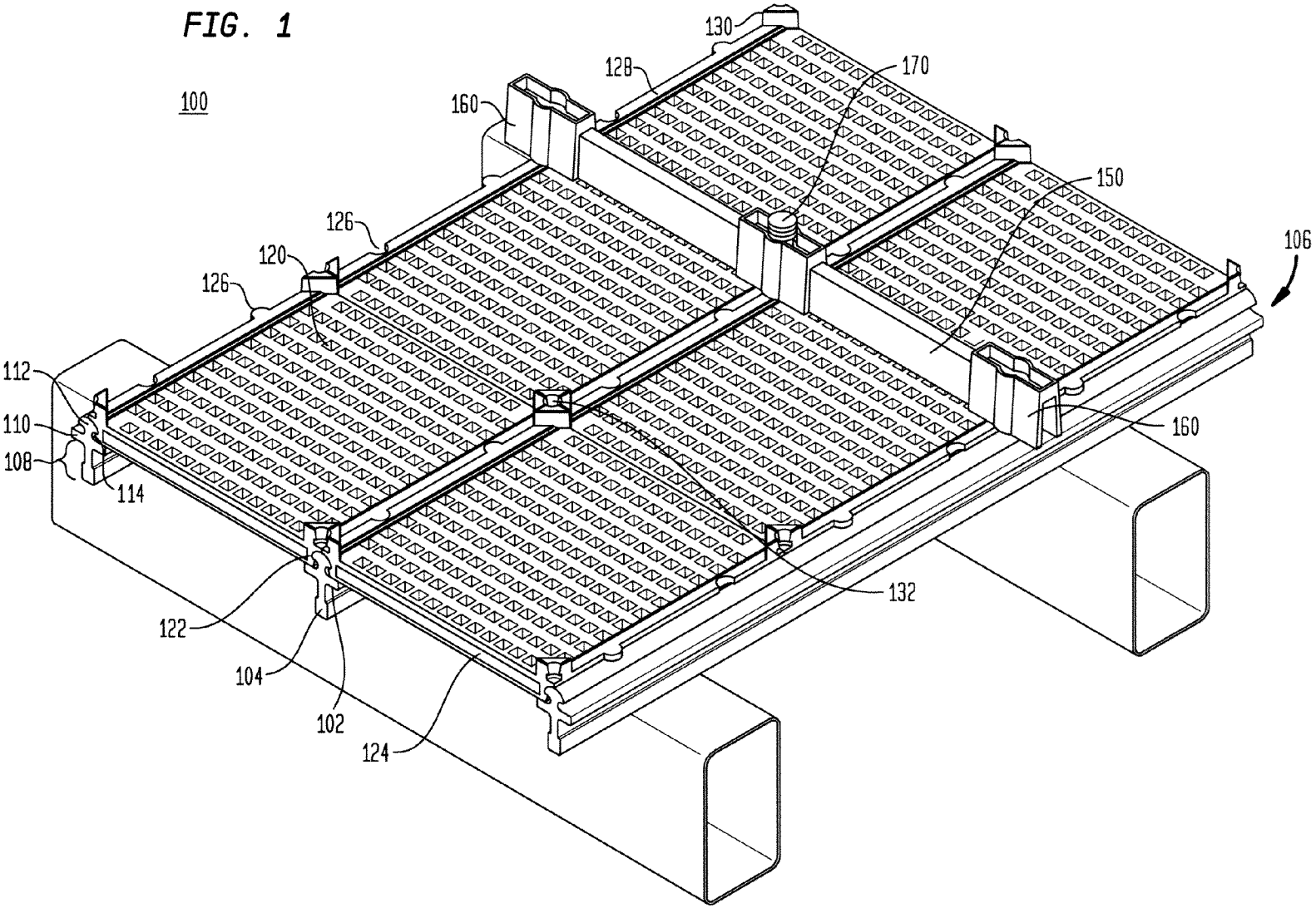
FIG. 1 is an isometric view of a screen deck assembly connected to supports of a vibratory machine.

Referring to FIG. 1, there is shown generally a screen deck assembly 100 of the present invention. The screen deck assembly 100 is connected to a vibratory machine which is used for separating bulk particulate materials, such as mineral bearing ore and aggregate, by size. One or more screen panels (alternatively referred to simply as "screens") 120 are positioned above the vibratory machine by securing the screens 120 to one or more connecting members 102.

The connecting member 102 has a first end 104 and a second end 106. The connecting member 102 is secured to and extends across two or more support bars on the vibratory machine. The connecting member 102 comprises a body 108, which forms the lower portion of the connecting member 102, a radial dome top 112, which forms the upper portion of the connecting member 102, and a transverse arm 110. The transverse arm 110 is generally perpendicular to the body 108, and the transverse arm 110 separates the body 108 from the radial dome top 112. A locking channel 114 is formed in the space between the transverse arm 110 and the radial dome top 112.

Each screen 120 has a molded side locking profile 122 adapted for corresponding to the locking channel 114 in the connecting member 102. The locking profile 122 fits in the locking channel 114 such that a screen 120 can be secured to the connecting member 102 by sliding or pressing the locking profile 122 into the locking channel 114. An internal support bar 124 can be molded into the vibratory screen 120 for adding latitudinal stiffness to the screen 120. One or more alignment tabs 126 are included along a side of the screen 120 to ensure proper alignment of each screen 120 to an adjacent screen 120. A raised side strip 128 is positioned along the outside edge of a screen 120 for keeping a product being screed on the screen 120 surface.

The screen 120 has one or more dam posts 130 positioned along one or more sides of the screen 120. The dam post 130 can be a partial quadrilateral such that when two screens 120 are placed side-by-side on a vibratory machine, the dam posts 130 from the adjacent screens 120 form a rhombus or other shape with a center aperture 132. The shape of the conjoined dam posts 130 corresponds to the shape of an opening in a dam cap 160, which, as discussed in more detail below, secures a dam 150 to the top surface of the screen 120. The aperture 132 formed in the center of the conjoined dam posts 130 corresponds to the size and shape of a locking key 170.

A dam 150 is detachably secured on a top surface of the screen 120 by a dam locking cap (alternatively referred to as a "dam cap") 160. The dam cap 160 has an opening that corresponds to the shape of, and is adapted for receiving, the conjoined dam posts 130 of adjacent screens 120. The dam cap 160 has a concave shape and is adapted for fitting over a dam 150 and for being detachably secured to the top surface of a screen 120. A locking key 170 can be pressed through the dam locking cap 160 and into the aperture 132 formed by the conjoined darn posts 130, thereby locking the dam 150 in place on the screen 120.

Figure 2:
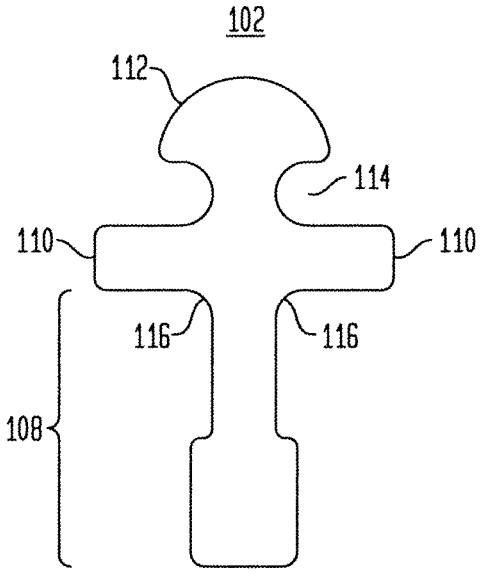
FIG. 2 is a planar end view of an elongated connecting member.

FIG. 2 provides an end-view of a connecting member 102. The connecting member 102 has a radial dome top 112 that, along with the transverse arm 110, is shaped to form a locking channel 114 for receiving a screen 120 therein. The locking channel 114 allows a screen 120 to be pressed down or slid into a locked position on the connecting member 102. The radial dome top 112 preferably has about a ½" radius and a smooth surface, which makes up part of the locking channel 114. The locking channel 114 extends the entire length of the connecting member 102 from the first end 104 to the second end 106. The transverse arm 110 is perpendicular to the body 108 of the connecting member 102 and the transverse arm 110 can support screens 120 of various sizes. The junction of the transverse arm 110 and body 108 can accommodate gussets 116 for strengthening the transverse arm 110 and the corresponding locking channel 114. The size and shape of the gussets 116 can be calculated to provide maximum strength to the transverse arms 110 without adding weight to the vibratory machine. The body 108 of the connecting member 102 is an elongated steel bar that functions to secure the connecting member 102 to the vibratory machine. The body 108 of the connecting member 102 can be connected to a vibratory machine by any mechanical means known to those skilled in the art, such as by welding, mechanical brackets or braces, screws, bolts, etc. The most preferred means for connecting the body 108 to an existing vibratory machine support is by welding.

Figure 3A:
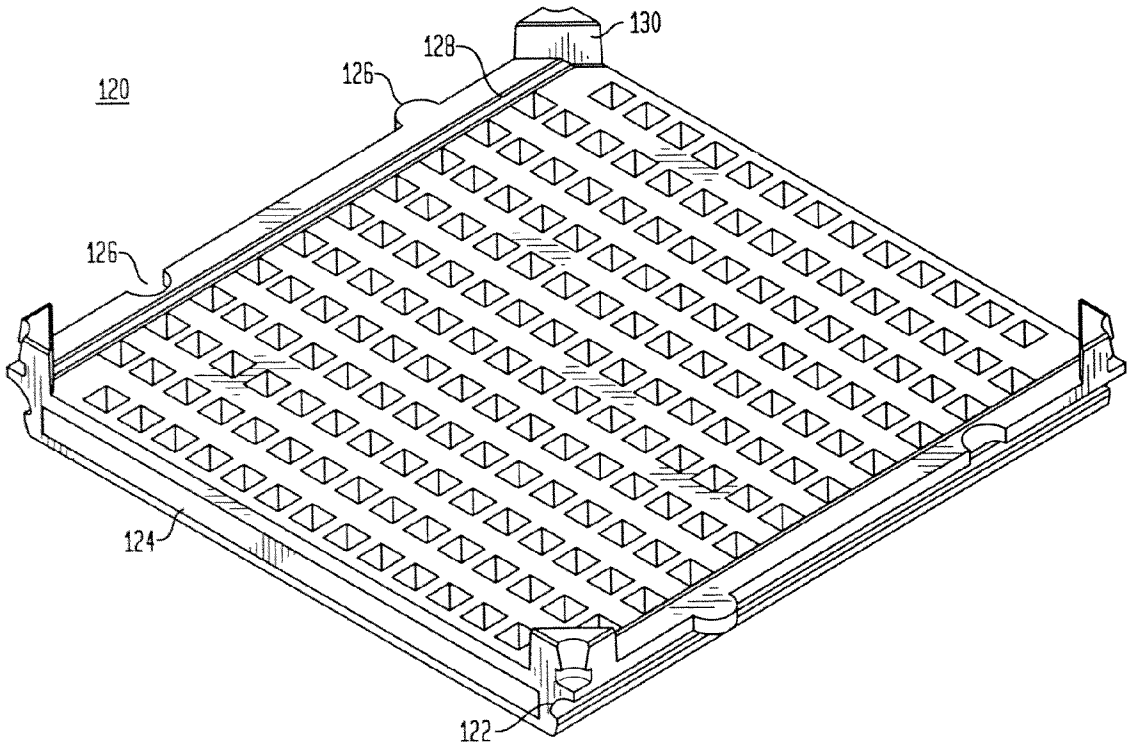
FIG. 3A is an isometric view of a screen.
Figure 3B:
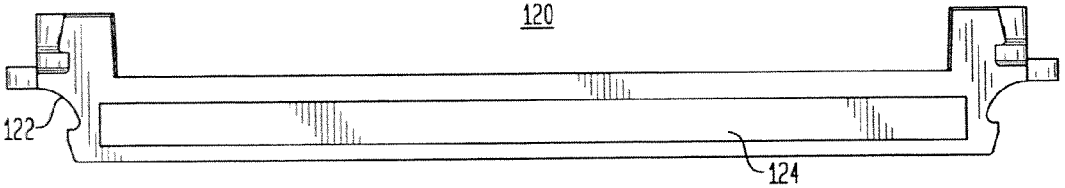
FIG. 3B is a planar side view of a screen.

FIGS. 3A and 3B show a screen 120 in isolation and also provide a side view of the same. The screen 120 has a molded side locking profile 122 that corresponds to the locking channel 114 of the connecting member 102, and which provides superior screen 120 locking power. The screen 120 also has a molded internal support bar 124 for providing stiffness latitudinal from the transverse arm 110. The ends of the internal support bar 124 are positioned over the transverse arm 110 of the connecting member 102 to provide inter-connecting support of a screen panel 120. The screen 120 has alignment tabs 126 to assure proper alignment of a first screen 120 to an adjacent screen panel 120. The preferred screen 120 has a raised side-strip 128 for added wear protection and to help keep material being screened, e.g., coal, aggregate, etc., in the screening area of the screen 120. The screen 120 has one or more dam posts 130 adapted for receiving a dam cap 160. The dam posts 130, along with a locking key 170, are used to secure a dam 150 to one or more screen panels 120.

Figure 4:
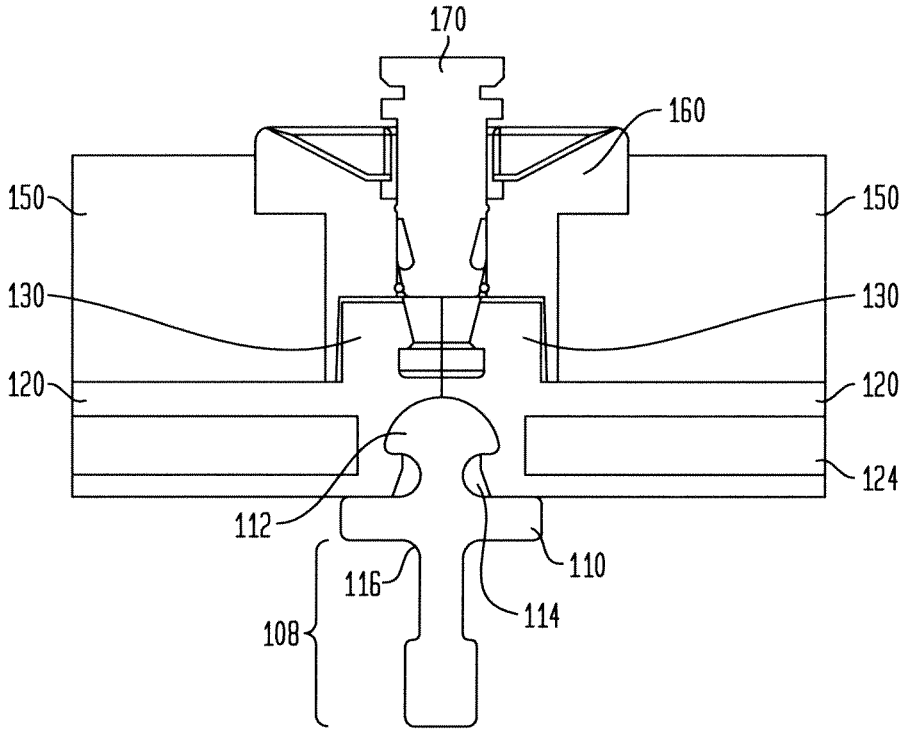
FIG. 4 is a sectional view of a screen deck assembly.

FIG. 4 shows a sectional view of a screen deck assembly 100. The locking profile 122 of the screens 120 is placed in the locking channel 114 of the connecting member 102. When adjacent screen panels 120 are secured to a connecting member 102, dam posts 130 from the adjacent screens 120 form a 4-walled protrusion, preferably a rhomboid shape, with an aperture in the middle. The dam posts 130 are conjoined at about 12" intervals, which allows a dam locking cap 160 and locking key 170 to be used to secure a dam 150 to the top surface of a screen 120. A dam 150 is positioned between conjoined dam posts 130 of adjacent screens 120. The dam locking cap 160 has an internal concavity for receiving the conjoined dam posts 130. The dam cap 160 also has laterally extending tab sections on each side for connecting the dam locking cap 160 to the dams 150. An aperture in the middle of the dam cap 160 aligns with the aperture 132 in the conjoined dam posts 130 when the dam cap 160 is positioned over the dam 150. The dam cap 160 is held in place with a locking key 170, which is locked in place by inserting the locking key 170 through the center opening in the dam cap 160 and into the aperture 132 formed by the conjoined dam posts 130. When locked, the head of the locking key 170 is about even with the top of the dam cap 160. The dam cap 160 thus is held down by the head of the locking key 170, and in turn the dam cap 160 holds the dams 150 in place on the top surface of the screen 120. To remove the dam 150, a lever, such as a screwdriver, flat bar, etc, can be used to raise the locking key 170 into an unlocked position thereby allowing the dam cap 160 and dam 150 to be removed from the screen 120.

Figure 5:
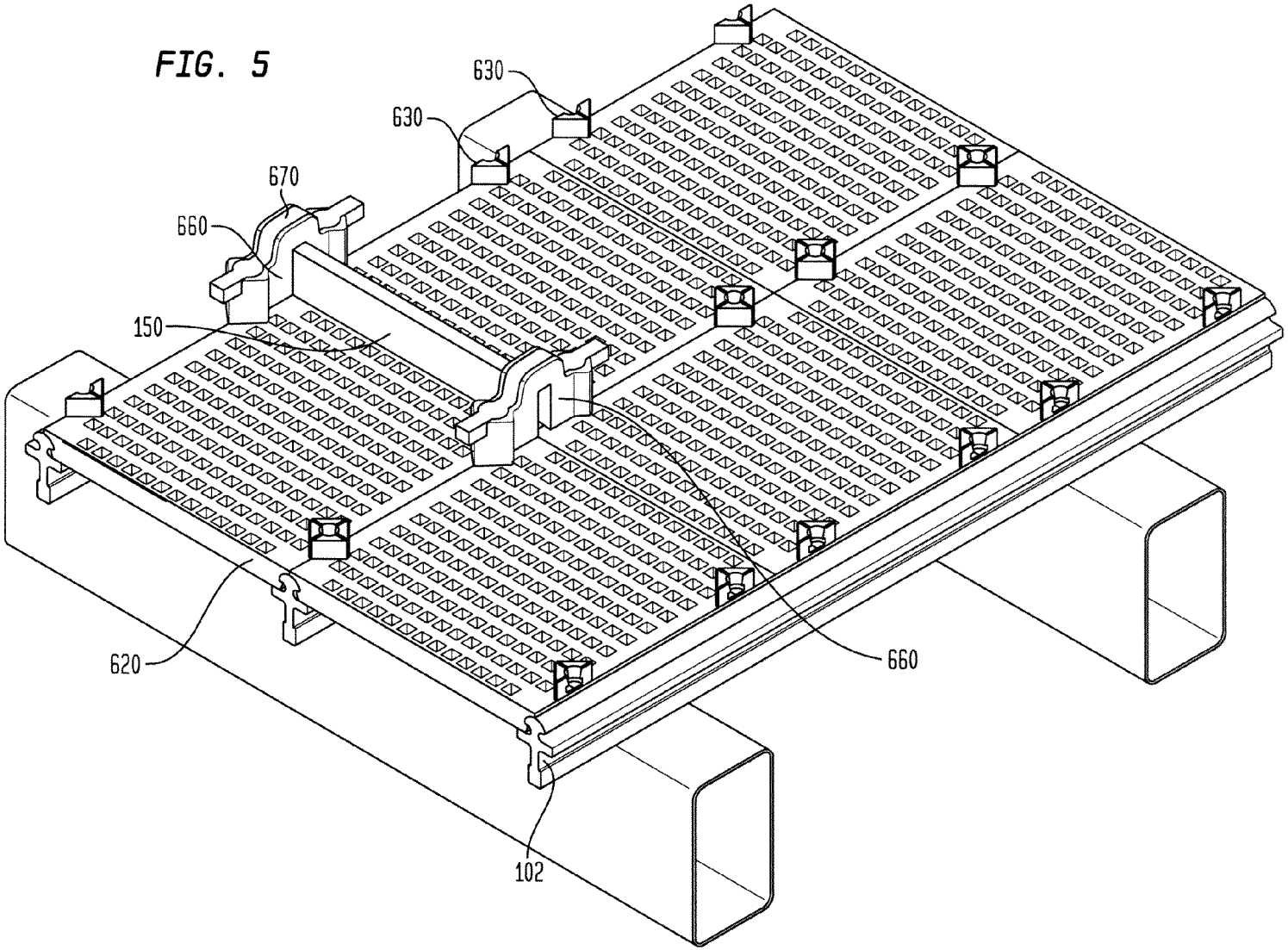
FIG. 5 is an isometric view of a screen deck assembly with an alternative dam assembly.
Figure 6:
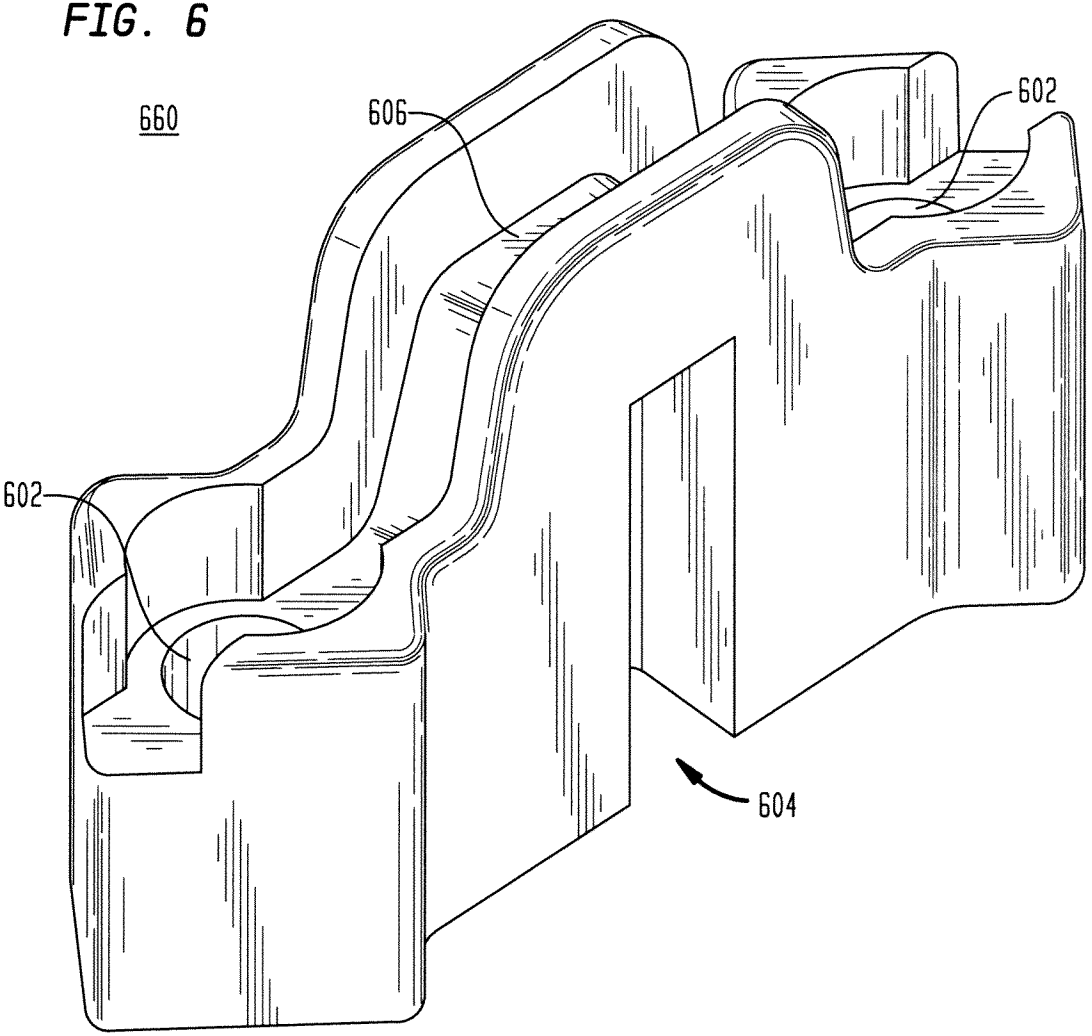
FIG. 6 is an isometric view of an alternative embodiment of a dam cap.
Figure 7:
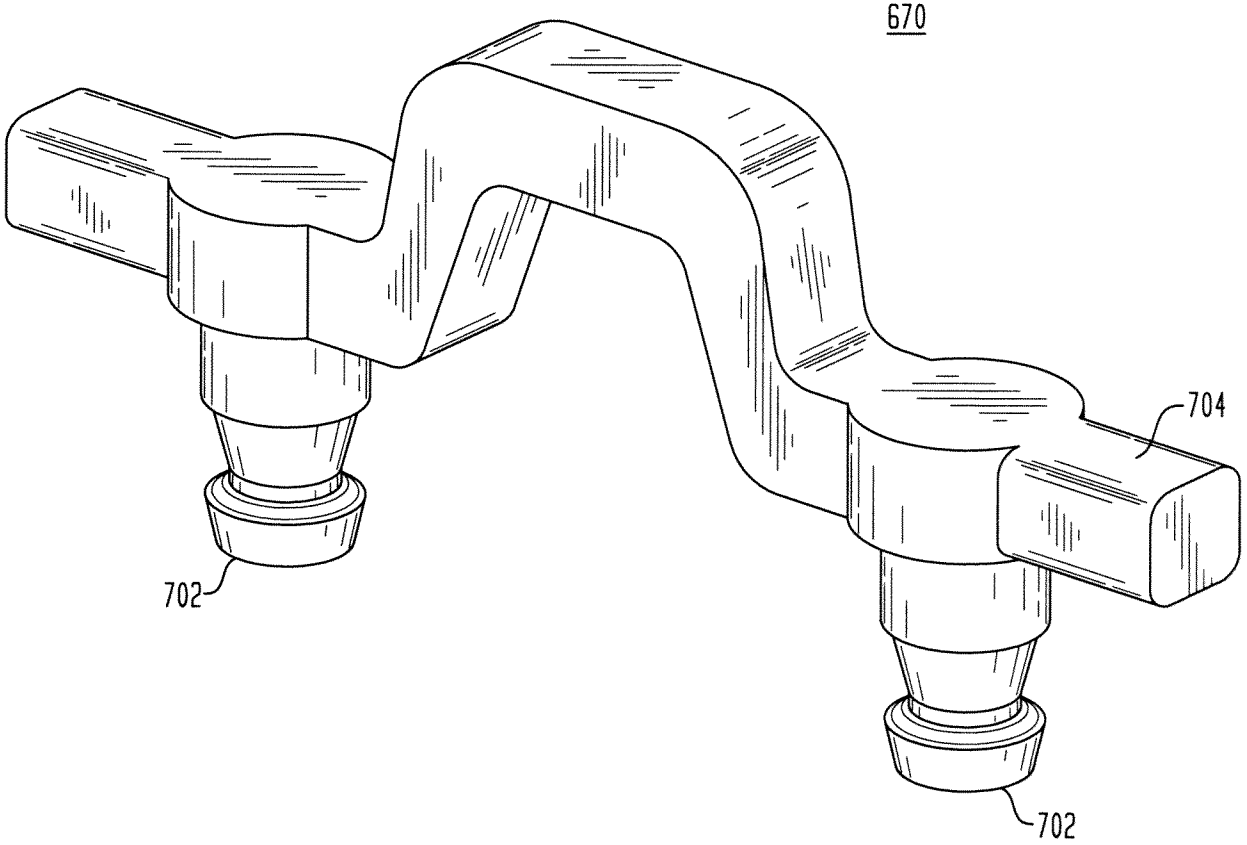
FIG. 7 is an isometric view of a dam locking wedge for use with the dam cap shown in FIG. 6.

An alternative embodiment of a screen 620, dam cap 660, and locking key 670 is shown in FIGS. 5 through 7. Referring to FIG. 5, each dam post 630 is positioned on the side of the screen 620 approximately 1 to 2 inches inward from the corner of the screen 620. When adjacent screen panels 620 are placed side-by-side, the conjoined dam posts 630 form a rhombus or other shape corresponding to a recessed section in the dam cap 660. The conjoined dam posts 630 have an aperture 632 for receiving a corresponding locking key 670. A dam 150 is positioned on the screen 620 such that there is a set of conjoined dam posts 630 on each side of the dam 150 at both ends, i.e., the dam 150 is positioned between four sets of conjoined dam posts 630 rather than two sets of conjoined dam posts 630. A double dam cap 660 is used to secure the dam 150 onto the top surface of the screen 620.

Referring to FIG. 6, the double dam cap 660 has an aperture 602 at each end which corresponds to the aperture formed in the conjoined dam posts 630. A recessed portion 604 in the double dam cap 660 corresponds to the shape of, and fits over the top of, a dam 150. When placed over a dam 150, the double dam cap 660 encompasses two conjoined sets of dam posts 630, one on each end of the double dam cap 660. The conjoined sets of dam posts 630 preferably are on adjacent screens 120. The double dam cap 660 has an indentation 606 along its top surface for receiving a locking key (alternatively referred to as a "dam wedge" or simply a "wedge") 670.

FIG. 7 shows a dam wedge 670 that has two posts 702 corresponding in shape and length to the apertures 602 that run through the double dam cap 660 and the conjoined dam posts 630. The dam wedge 670 is shaped to correspond to the indentation 606 along the top surface of the double dam cap 660. The wedge 670 can have a tab 704 on each end that extends beyond the posts 702. The tabs 704 provide a means for removing the wedge 670 from the double dam cap 660 simply by pulling up one of the tabs 704.

Figure 8:
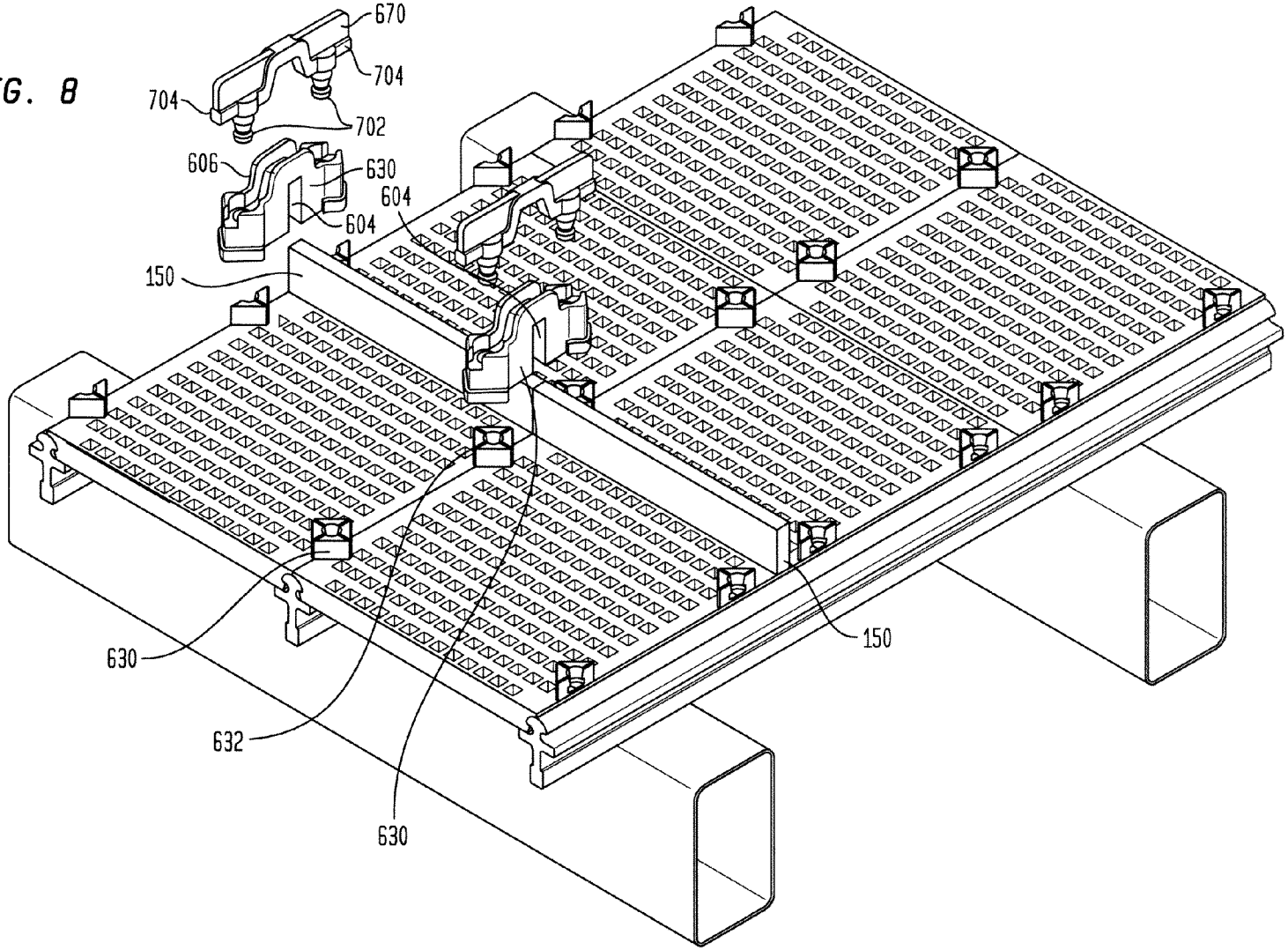
FIG. 8 is an isometric view of an alternative embodiment of a screen deck assembly connected to supports of a vibratory machine.

FIG. 8 provides an exploded view of the dam wedge 670 being used to secure two dams 150 to a matrix of screen panels 620. Dam posts 630 of the adjacent screens 620 form a rhomboid protrusion on the top surface of the screens 620. An aperture 632 extends downward through the conjoined dam posts 630. A dam 150 is positioned along the intersection of two screen panels 620 such that each end of the dam 150 is between two sets of conjoined dam posts 630, i.e., one set of conjoined dams posts 630 on each side of the dam 150. A double dam cap 660 is placed over the top of the dam 150 by aligning the recessed portion 604 of the double dam cap 660 with the top surface of the dam 150 and the apertures 602 in the double dam cap 660 with the apertures 632 formed in the conjoined dam posts 630. The wedge 670 is positioned in the indentation 606 along the top of the double dam cap 660 with the posts 702 of the wedge 670 extending down through the apertures 602, thereby locking the dam 150 in place on the screens 620. The double dam cap 660 is removed simply by pulling up on one of the tabs 704 that extend beyond the posts 702 of the double dam cap 660.

Figure 9:
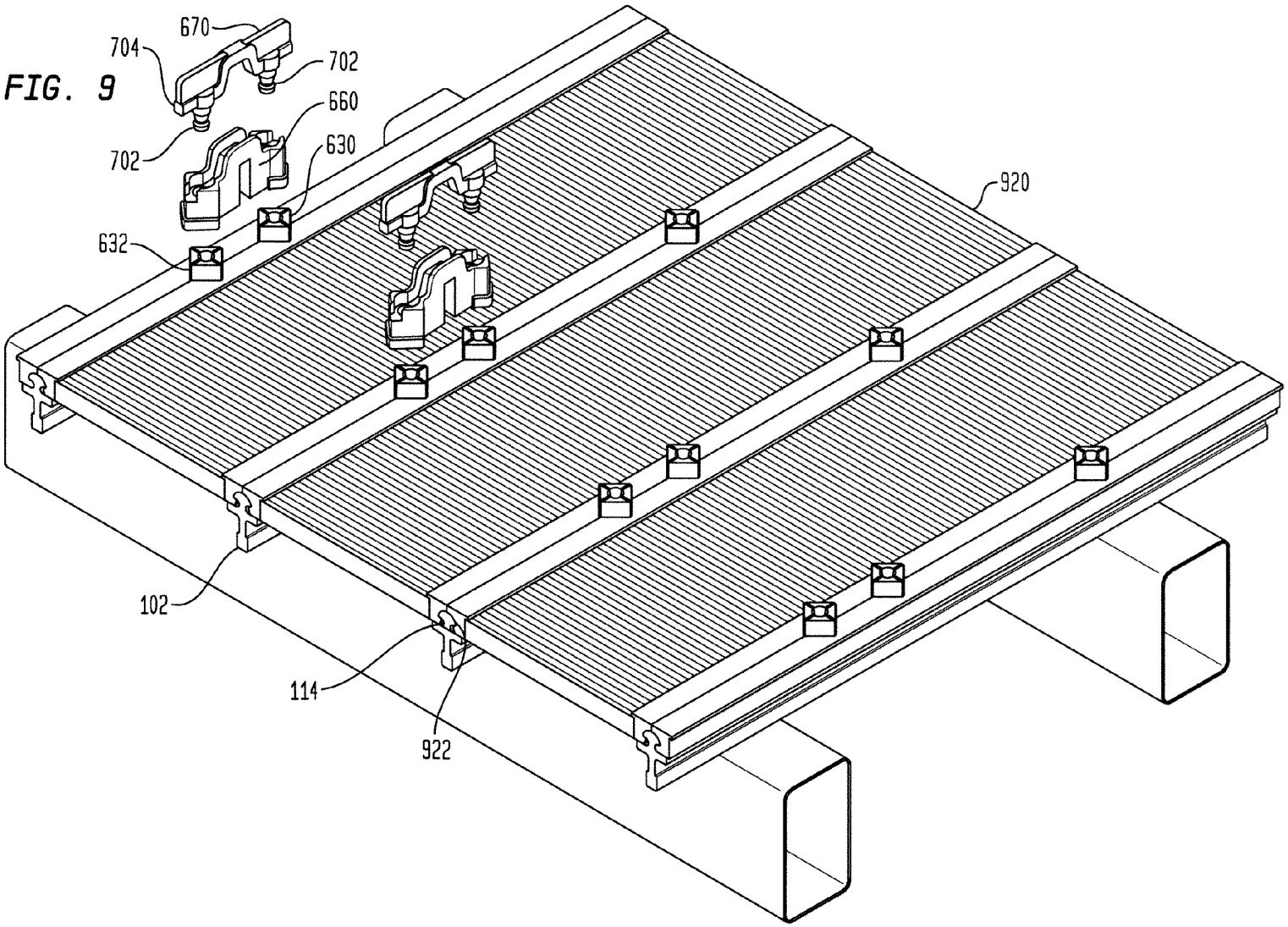
FIG. 9 is an isometric view of an alternative embodiment of a screen deck assembly connected to supports of a vibratory machine.

FIG. 9 shows the double dam cap 660 and wedge 670 used as hold down pins for an interconnected matrix of screen panels 920. The screen panels 920 are locked in place over a vibratory machine by sliding the locking profile 922 of the screen panels 920 in the locking channel 114 of the connecting member 102, which is secured to the vibratory machine. Dam posts 630 of the adjacent screens 920 form a rhomboid-shaped protrusion on the top surface of the screens 920. An aperture 632 extends downward through the conjoined dam posts 630. A double dam cap 660 is positioned with the apertures 602 in the double dam cap 660 aligned with the apertures 632 formed in the conjoined dam posts 630. The wedge 670 is positioned in the indentation 606 along the top of the dam cap 660 with the posts 702 of the double dam wedge extending down through the apertures 602, thereby locking the screens 620 in place relative to one another. The screens 620 can be replaced simply by removing the double dam cap 660 by pulling up on one of the tabs 704 that extend beyond the posts 702 of the double dam cap 660, and sliding the screen 920 out of the locking channel 114 in the connecting member 102.

Conclusion

While various embodiments of the present invention have been described above, it should be understood that they have been presented by way of example only, and not limitation. It will be understood by those skilled in the art that various changes in form and details may be made therein without departing from the spirit and scope of the invention. Thus, the breadth and scope of the invention should not be limited by any of the above-described exemplary embodiments.

What is claimed is:

1. A screen system, comprising:

an elongated connecting member having a first end and a second end, and comprising a body, a transverse arm contiguous with and generally perpendicular to the body, and a convex radial dome top positioned centrally above the transverse arm in vertical alignment with the body such that a slide-locking channel is formed on each side between the transverse arm and a lateral aspect of the radial dome top;

a screen having a locking profile adapted for corresponding to the locking channel formed between the radial dome top and the transverse arm; the screen further comprising an internal support bar molded in the screen for adding latitudinal stiffness to the screen, an alignment tab on a side of the screen for aligning a screen to an adjacent screen, a raised side strip along a side of the screen for keeping product to be screened from falling off the side of the screen, and a dam post along the side of the screen adapted for receiving a dam cap;

a dam detachably positioned on top of and extending across the screen;

a dam locking cap having a recessed opening for receiving one or more dam posts and a dovetail adapted for receiving a dam; and a locking key pressably secured within the dam locking cap for securing the dam to the top surface of the screen.

2. A screen deck assembly, comprising:

an elongated connecting member for connecting the screen to a vibratory machine, the elongated connecting member comprising:

a body;

a transverse arm contiguous with and generally perpendicular to the body; and a convex radial dome top positioned centrally above the transverse arm in vertical alignment with the body such that a slide-locking channel is formed on each side between the transverse arm and a lateral aspect of the radial dome top, and wherein the locking channel extends the entire length of the elongated connecting member; and a screen having a locking profile that corresponds to the locking channel between the transverse arm and the radial dome top in the connecting member.

3. The screen deck assembly of claim 2, wherein the screen further comprises a dam post positioned at each corner of the screen and extending vertically from the surface of the screen.

4. The screen deck assembly of claim 2, wherein the screen further comprises an internal support bar molded in the side of the screen.

5. The screen deck assembly of claim 2, wherein the screen further comprises an alignment tab on a side of the vibratory screen for assuring proper alignment to an adjacent screen.

6. The screen deck assembly of claim 2, wherein the screen further comprises a raised side strip along a side of the screen for keeping a product to be screened on the screen surface.

7. The screen deck assembly of claim 2, further comprising a dam detachably positioned on top of and extending across the screen.

8. The screen deck assembly of claim 7, further comprising a dam locking cap having a recessed opening for receiving one or more dam posts and a dovetail adapted for receiving a dam.

9. The screen deck assembly of claim 8, further comprising a locking key pressably secured within the dam locking cap for securing the dam to the top surface of the screen.

10. The screen deck assembly of claim 9, wherein the locking key is a dam wedge.

11. The screen deck assembly of claim 8, wherein the dam locking cap is a double dam locking cap.

12. The apparatus of claim 11, wherein the elongated body, transverse arm, and radial dome top are extruded from a single steel bar.

13. A connecting member for securing one or more screen panels to a vibratory machine, comprising:

an elongated body having a length extending from a first end and a second end;

a transverse arm contiguous with and generally perpendicular to the elongated body;

a convex radial dome top positioned centrally above the transverse arm in vertical alignment with the elongated body such that a slide-locking channel is formed on each side between the transverse arm and a lateral aspect of the radial dome top, wherein the locking channel extends the entire length of the elongated body.

* * * * *